US005206928A

United States Patent [19]

Spörri

[11] Patent Number: 5,206,928

[45] Date of Patent: Apr. 27, 1993

[54] THERMOSTAT-CONTROLLED WATER HEATING DEVICE FOR A BIDET OF A WATER CLOSET WITH DAMPED COLD WATER INFLOW

[75] Inventor: Beat Spörri, Uzach, Switzerland

[73] Assignee: Geberit AG, Jona, Switzerland

[21] Appl. No.: 679,289

[22] Filed: Apr. 2, 1991

[30] Foreign Application Priority Data

Apr. 3, 1990 [CH] Switzerland ..... 1108/90

[51] Int. Cl.[5] ..... A61H 35/00; A47K 7/08; F24H 00/00

[52] U.S. Cl. ..... 392/491; 4/420.1; 4/420.2; 4/443; 392/487; 392/498

[58] Field of Search ..... 392/485–494, 392/498; 4/443–448, 420.1, 420.2, 420.3, 420.4, 420.5

[56] References Cited

U.S. PATENT DOCUMENTS

| | | | |
|---|---|---|---|
| 3,462,766 | 8/1969 | Merkel | 4/420.2 |
| 3,638,619 | 2/1972 | Hall et al. | 392/487 |
| 4,360,934 | 11/1982 | Ishigami et al. | 4/420.2 |
| 4,559,651 | 12/1985 | Tanahashi et al. | 4/420.2 |
| 4,841,582 | 6/1989 | Matsui et al. | 4/420.1 |

FOREIGN PATENT DOCUMENTS 597447 4/1978 Switzerland .

*Primary Examiner*—Anthony Bartis
*Attorney, Agent, or Firm*—McGlew and Tuttle

[57] ABSTRACT

A fluid heater and storage device for a bidet includes an electric heater (3) positioned inside a housing (1) in a lower portion thereof. The housing (1) has a connection side with an inlet opening (6) and an outlet opening (7) for the fluid to enter and exit the housing located in an upper portion of the connection side. An insert (10) is positioned in the upper portion the housing (1) adjacent to the inlet opening (6). The insert (10) receives input fluid from the inlet opening (6) and guides the fluid along the connection side towards the lower portion of the housing (1). The input fluid then flows across the bottom of the housing and is heated by the heater (3) as it flows the recross. The heated fluid then rises along the housing side opposite to the connection side towards the top of the housing and then back towards the connection side where it is separated from the input fluid by a wall (1c) in the upper portion of the housing (1) forming a passage for removing heated water from the upper portion of the housing (1) through outlet opening (7).

10 Claims, 3 Drawing Sheets

THERMOSTAT-CONTROLLED WATER HEATING DEVICE FOR A BIDET OF A WATER CLOSET WITH DAMPED COLD WATER INFLOW

FIELD OF THE INVENTION

The present invention pertains generally to a heating device for a bidet and more particularly to a thermostat-controlled hot water storage tank for a bidet accommodated in a hollow projection of a toilet seat, comprising an electrical heater, a temperature sensor, a water inlet for the cold water and a water outlet, which is to be connected to a water pipe leading to a shower arm, wherein the water inlet and the water outlet are located on the same side of the hot water storage tank.

BACKGROUND OF THE INVENTION

Heating devices, also called hot water storage tanks or boiler, in which cold water enters at the bottom into an inner tank through an inlet tube and the hot water is discharged through an outlet arranged at the upper end of the inner tank due to displacement, are well-know. Furthermore, Swiss publication CH-A 597,447 discloses a heating device which has a heating chamber, in which the cold water flowing in is heated in the manner of an immersion heater, and a storage chamber following it in the direction of flow, in which the heated shower water is kept ready for use. This subdivision of the inner space of the heating device is said to ensure uniform water temperature in the storage chamber. The storage chamber and the heating chamber are subdivided by a horizontal tube section, which permits counterflow of the water. Correspondingly the outlet for the water from the storage chamber and the inlet for the cold water are arranged on the same side of the tube section. This heating device has a cylindrical outer shape and is therefore suitable for installation in a correspondingly tubular installation element, in which the other devices for the bidet are also accommodated, and which is installed in the hollow projection of the toilet seat. In contrast, this heating device is associated with the difficulty that the outer shape is practically completely defined by the above-mentioned design. Toilet seats with such a heating device correspondingly have a relatively tall projection, which often fails to meet the aesthetic requirements imposed on modern installations. Especially a toilet seat with a larger and flatter top side and a correspondingly lower projection would be desirable.

SUMMARY AND OBJECTS OF THE INVENTION

It is primary object of the present invention to provide a heating device which imposes fewer restrictions in terms of the outer shape, but is nevertheless suitable for a bidet of a water closet or toilet.

According to the invention, a thermostat-controlled hot water storage tank for a bidet is provided which may be accommodated in a hollow projection of a toilet seat. The arrangement comprises an electrical heater, a temperature sensor, a water inlet for the cold water and a water outlet, which is to be connected to a water pipe leading to a shower arm. The water inlet and the water outlet are located on the same side of the hot water storage tank. The water inlet and the water outlet are arranged in an upper area; such that beneath it, an insert for damping the pressure of the water flowing in under mains pressure is arranged in a cavity of the heating device. The water flowing in is guided from top to bottom onto an insert. The water inlet and the water outlet are separated from each other by a separating means that is open toward the cavity.

In the heating device according to the present invention, the water flowing into the inside of the housing under mains pressure is damped practically completely immediately after entering. Without any need for subdivision into a heating chamber and a storage chamber, uniform heating of the water to the desired body temperature can be achieved over a relatively short flow path. Contrary to the prior-art heating devices, both the water inlet and the water outlet are arranged in the upper area of the housing in the device according to the present invention. Consequently, the cold water flowing in, flows essentially from top to bottom, and the water flows to the outlet from the bottom to the top. The inner space and correspondingly also to the outer shape of the heating device can be selected practically freely. In particular, a teardrop-shaped cross section and lower height of the housing of the heating device are possible. This is particularly advantageous for the shaping of the toilet seat.

Particularly effective damping of the cold water flowing in is achieved if, according to a variant of the present invention, an insert with a horizontal plate is provided in the inner space of the housing, and this horizontally extending plate has perforations for the passage of the water flowing in the downward direction. The damping effect is further enhanced if this plate has upwardly directed ribs or projections.

According to a feature of the present invention, the insert has upwardly directed webs, on which—at a spaced location from the plate—a partition is arranged, which deflects the cold water flowing in toward the housing in the upward direction. Thus, the cold water flows upward for a short distance immediately after admission, and is then deflected by the housing wall in the downward direction. This measure also contributes to rapid damping of the water flowing in at a relatively high velocity.

According to another feature of the present invention, the thermostat is a capillary tube thermostat and is arranged above the heating element. Experiments have shown that very good temperature characteristics are obtained due to this arrangement despite the unconventional design. Further advantageous characteristics will become apparent from the following description One exemplified embodiment of the present invention will be explained in greater detail below on the basis of the drawings.

The various features of novelty which characterize the invention are pointed out with particularity in the claims annexed to and forming a part of this disclosure. For a better understanding of the invention, its operating advantages and specifics objects attained by its uses, reference is made to the accompanying drawings and descriptive matter in which a preferred embodiment of the invention is illustrated.

BRIEF DESCRIPTION OF THE DRAWINGS in the drawings.

DETAILED DESCRIPTION OF THE PREFERRED EMBODIMENT

Figure 1:
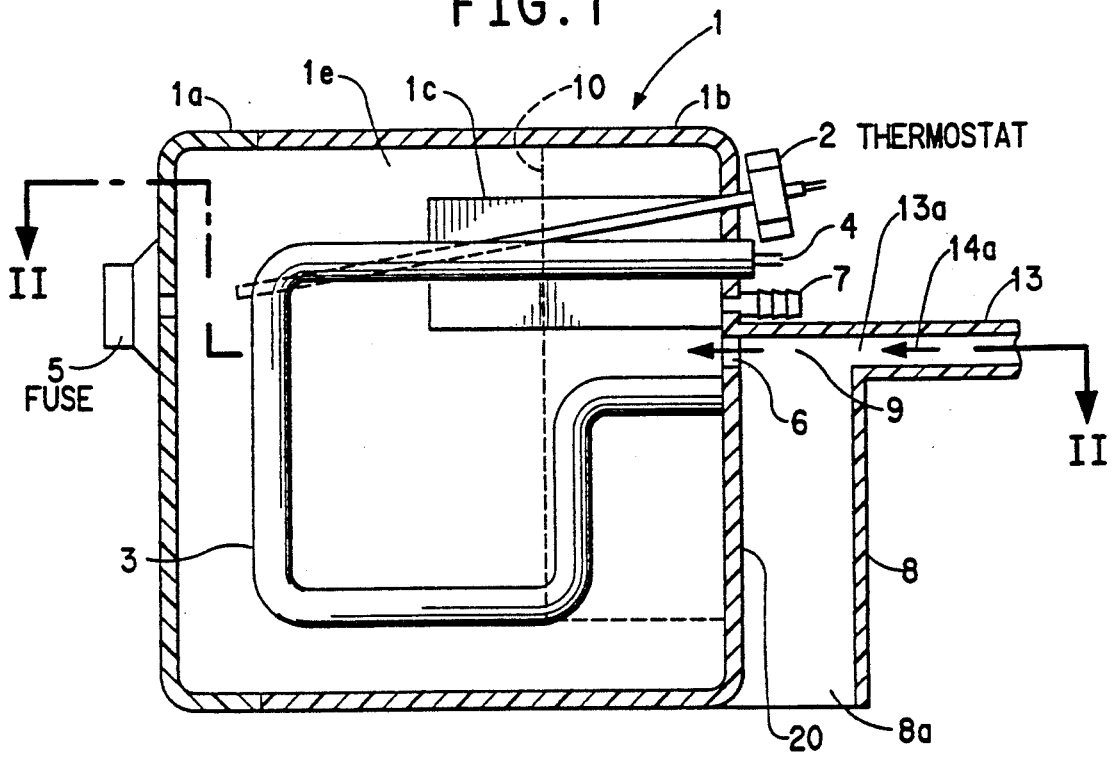
FIG. 1 is a horizontal sectional view through a heating device according to the present invention along line I—I in FIG. 2 wherein the insert is shown only in outline.
Figure 2:
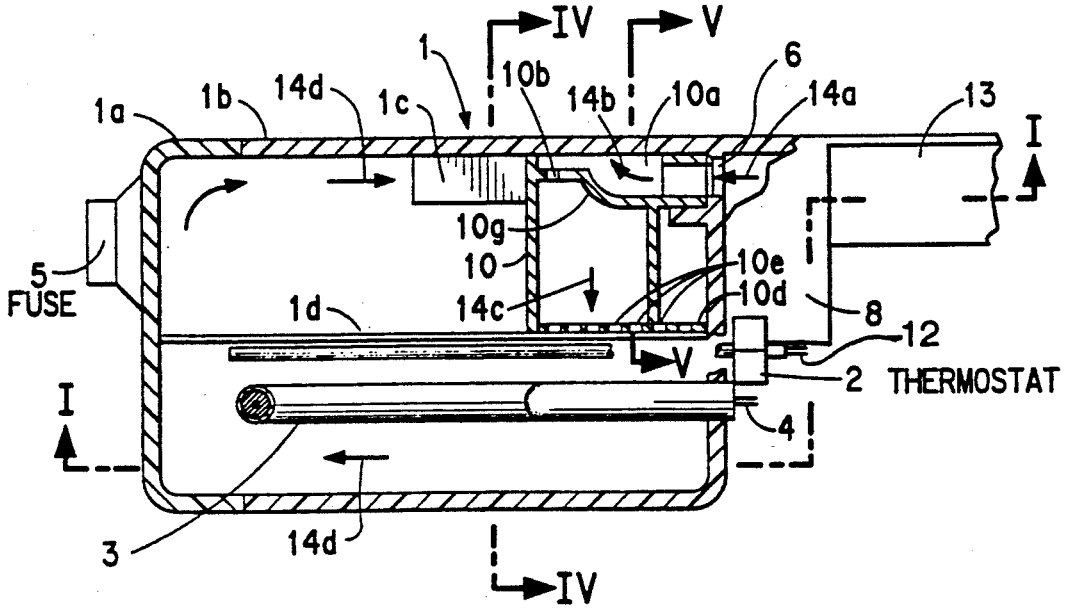
FIG. 2 is a vertical sectional view taken through the heating device along II—II in FIGS. 1, 3, 4, and 5.

The heating device according to the invention includes a thermally well-insulated plastic housing 1 consisting of a lid 1*a* and a housing body 1*b*. The lid 1*a* has a known fuse 5 and is sealingly connected to the body 1 on all sides by vibration welding. A heating element 3 bent into a flat loop, as well as a capillary tube thermostat 2, are fastened on the housing body 1*b* and are connected to electrical control and power supply lines 12 and 4 respectively, outside the housing in the known manner. The heating element 3 and thermostat, are inserted into the cavity of the housing 1. As is apparent especially from FIG. 2, the heating element 3 is arranged in the lower area of the cavity 1*e*, and the thermostat 2 is located above the heating element 3.

Figure 3:
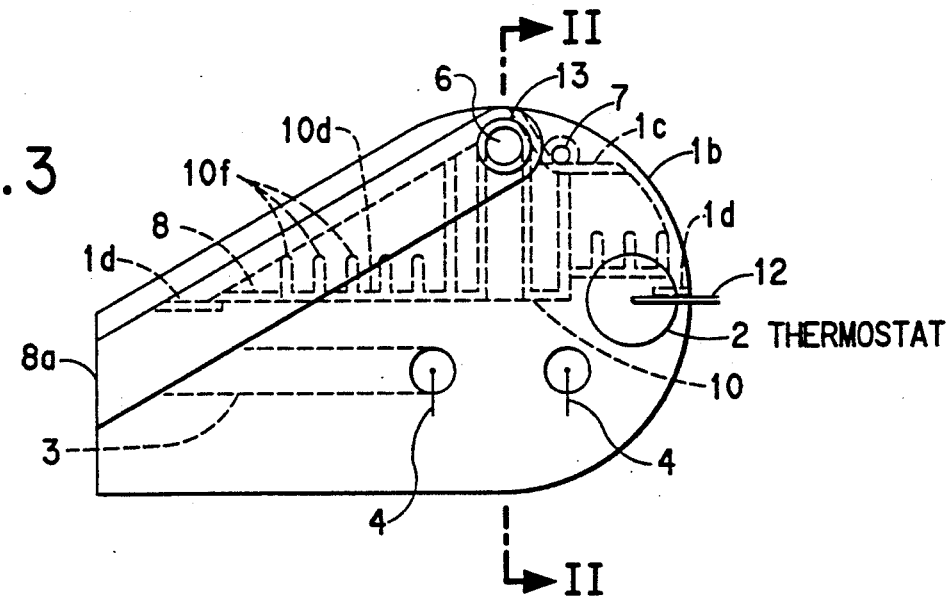
FIG. 3 is a side view of the heating device as seen from the right in figure
Figure 4:
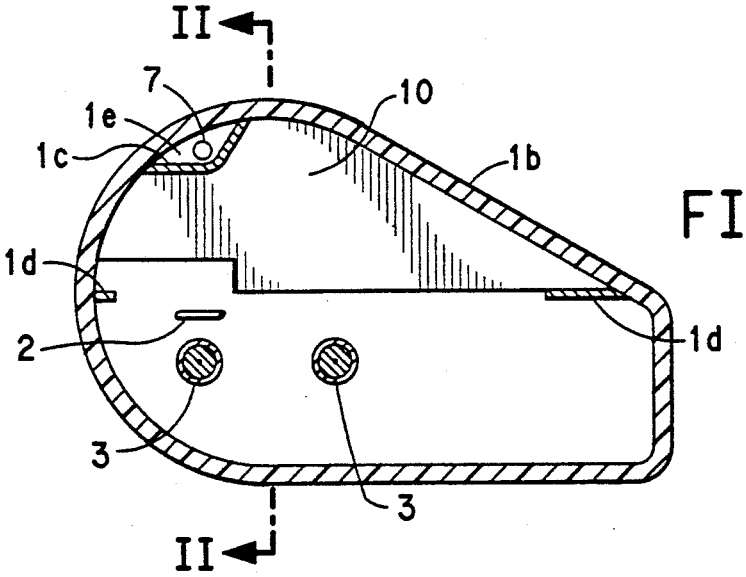
FIG. 4 is a cross sectional side view of the housing body along line IV—IV in FIG. 2.

A connection 13, which is made in one piece with an overflow channel 8 made in one piece with a housing body 1*b*, is provided on a connection side 20 to admit the cold water. According to FIG. 3, the channel 8 leads downward and, with an opening 8*a*, to the outside. A tube interruptor 9, which is formed by a free section between the opening 13*a* of the connection part 13 and a water inlet opening 6 in known manner, is located in the upper part of the channel 8. The minimum length of this section is usually not specified. In the case of vacuum in the cold water line, the tube interruptor prevent water from entering the water mains from the inner space 1*e*. In this case, only air is drawn through the opening 8*a* into the water mains. The tube interrupter 9 also forms an overflow protection means here. The upper area of the cavity 1*e* is connected to the atmosphere through the opening 6 and the channel 8, so that no hazardous overpressure can build up in the space 1*e*. Thus, a tube interruptor and overflow protection means, which can be manufactured in an advantageous manner, are realized in the heating device according to the present invention. The path of the cold water flowing in through the opening 6 is indicated by the arrows 14*a*, 14*b*, and 14*c* in FIGS. 2 and 5. This flow path leads, in conjunction with an insert 10, to rapid damping of the water flowing in under mains pressure. The water flowing horizontally through the opening 6 enters a pre-chamber 10*a* arranged in the upper part of the space 1*e*, where the water is deflected upward in the direction of arrow 14*b* and to the side, i.e., to the left and right, in the direction of the arrows 14*b*. This direction of flow is substantially affected by a partition 10*g* of the insert 10, as well as by the housing body 1*b*. The water, which has already been partially damped, subsequently flows downward in the direction of the arrows 14*c* against a plate 10*d* of the insert 10, plate 10*d* has a plurality of passages 10*e* as well as upwardly projecting ribs 10*f*. The ribs 10*f* and passages 10*e* dampen the water, so that it flows downward with low velocity under the plate 10*d* and is heated by the heater 3. The heated water moves across the bottom of the housing and rises upward due to natural buoyancy and approximately in the direction of arrows 14*d* (FIG. 2), along a separating means for separating the hot and cold water and having a wall 1*c* and to an outlet opening 7, from which the heated water reaches a shower arm via a hose not shown here. The wall 1*c* is made in one piece with the housing 1, and it guarantees that the above-mentioned outflowing water is separated from the cold water flowing in the area of the two openings 6 and 7.

Figure 5:
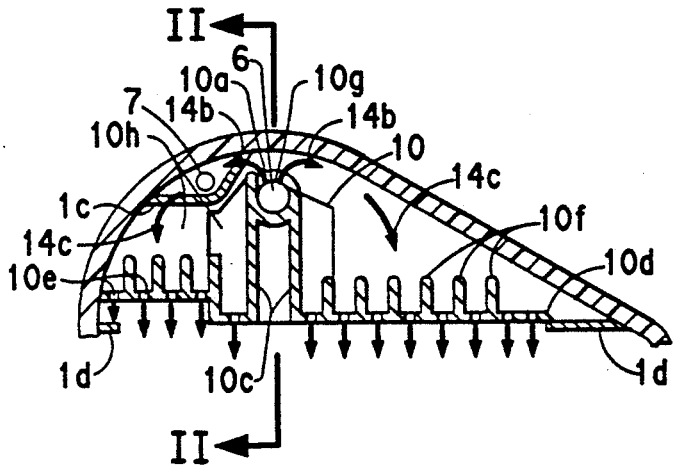
FIG.5 is a vertical sectional view through the insert.
Figure 6:
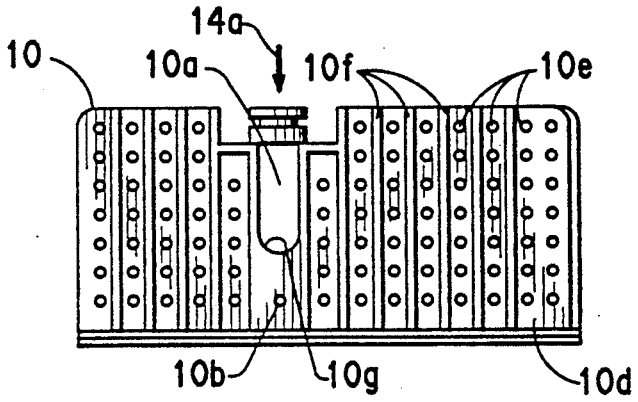
FIG. 6 is a top view of the insert.
Figure 7:
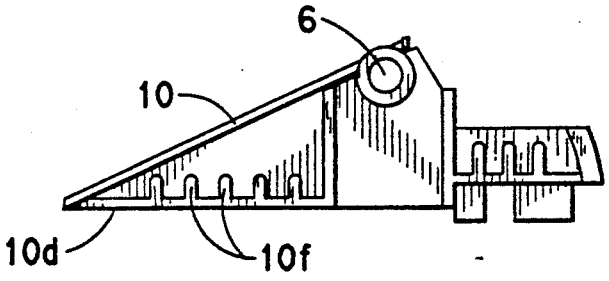
FIG. 7 is a vertical plan view of the insert.

The insert 10 shown in FIGS. 5 and 6 is manufactured from plastic as a separate part and is inserted into the housing body 1*b* before the lid 1*a* is put in place, and the insert 10 is held by supports 1*d* on the housing body 1*b*. As is shown in FIG. 5, the partition 10*g* is connected to the plate 10*d* via two parallel webs 10*c*. A passage 10*b*, through which water can also flow from the chamber 10*a* to the heating body 3 in the downward direction, may also be provided in the partition 10*g*.

For protection, the heating device may, of course, have a temperature limiting device (not shown) in this case as well.

In the hot water storage tank according to the present invention, essentially the entire cavity 1*e* serves both as a heating chamber and as a storage chamber. Consequently, a relatively large amount of hot water can be stored under pressure despite small outside dimensions.

While a specific embodiment of the invention has been shown and described in detail to illustrate the application of the principles of the invention, it will be understood that the invention may be embodied otherwise without departing from such principles.

What is claimed is:

1. A fluid heater and storage device for a bidet to be accommodated in a hollow projection of a toilet seat, comprising: a hot water storage tank housing; an electrical heater positioned in said housing, a temperature sensor extending into said housing, a water inlet connected to said housing for admitting cold water; and a water outlet connected to said housing for connection to a water pipe leading to a shower arm, said water inlet and said water outlet being located on a same side of said housing and said water inlet and said water outlet being arranged in an upper area of said housing; insert means for damping the water flowing in said housing through said inlet under mains pressure, said insert means being arranged under said water inlet and inside said upper area of said housing, said insert means also guiding water flowing into said housing from a top of said housing to a bottom of said housing; and separating means being attached to said housing in said upper area for separating said cold water from said inlet and said insert means from hot water exiting said outlet, said separating means being open toward said inside of said housing.

2. A device in accordance with claim 1, wherein said insert means includes a substantially horizontally extending plate with perforations for the passage of the water flowing downward.

3. A device in accordance with claim 1, wherein said insert means includes upwardly directed ribs for damping water flowing in.

4. A device in accordance with claim 2, wherein said insert means includes upwardly directed webs attached to said substantially horizontal extending plate, said webs supporting a partition, at a spaced location from said substantially horizontal plate, said partition, being arranged substantially opposite the inlet and deflects the flow of the water flowing into the upward direction.

5. A device in accordance with claim 1, wherein said separating means includes a wall, which is arranged between said inlet and said outlet, and extends in a longitudinal direction of the housing.

6. A device in accordance with claim 5, wherein said partition is made in one piece with said housing.

7. A device in accordance with claim 1, wherein said temperature sensor is a capillary tube thermostat arranged above said heating element.

8. A device in accordance with claim 1, further comprising an overflow channel with a tube interrupter connected to said inlet and disposed on the outside of said housing on a same side as said inlet.

9. A fluid heater and storage device for a bidet, the device comprising:

a housing having a top, a bottom, a connection side and an opposite side substantially opposite to said connection side;

inlet means on an upper portion of said connection side and for delivering input fluid to an inside upper portion of said housing, said upper portion of said inside of said housing and said upper portion of said connection side being adjacent said top;

heater means positioned in a lower portion of said inside of said housing and for heating fluid surrounding said heater means, said lower portion of said inside of said housing being adjacent said bottom;

insert means positioned adjacent said top and connection side and for receiving and guiding said input fluid, said insert means being positioned between said top and said heater means, said insert means cooperating with said top and connection side to guide said input fluid after said input fluid leaves said insert means to flow along on inside of said connection side, toward said bottom and across said bottom, said input fluid also surrounding said heater means during said flow and said heater means heating said input fluid and causing said heated fluid to rise toward said top as said input fluid passes said heater means, said insert means further cooperating with said heater means, said opposite wall and said top to further flow said heated fluid along said opposite wall from said lower portion of said housing to said upper portion and across said top toward said connection side;

outlet means for removing the heated fluid from said upper portion of said housing, said outlet means being positioned at said upper portion of said connection side and adjacent said inlet means; and separating means positioned inside said housing, adjacent said top and said insert means, said separating means being for separating said input fluid from said heated fluid in said upper portion of said housing, and guiding said heated fluid from said inside of said housing to said outlet means, said separating means including a wall extending from said connection side and adjacent said top, said wall extending further away from said connection side than said insert means.

10. A device in accordance with claim 9, wherein:

said insert means includes partition means for directing said input fluid against said top, said insert means also having wall means for substantially containing said input fluid between said wall means and said connection side and substantially blocking mixing of said input fluid with heated fluid in a remainder of said upper portion of said inside of said housing, said insert means also including plate means between said partition means and said heater means, and also between said wall means and said connection side, said plate means damping said input fluid flowing in said insert means and substantially evenly distributing said input fluid along said connection wall.

* * * * *